US011325404B2

(12) United States Patent
Kinoshita et al.

(10) Patent No.: US 11,325,404 B2
(45) Date of Patent: May 10, 2022

(54) RECORDING APPARATUS INCLUDING ROLL BODY SUPPORT UNIT

(71) Applicant: SEIKO EPSON CORPORATION, Tokyo (JP)

(72) Inventors: Masaaki Kinoshita, Shiojiri (JP); Hitoshi Igarashi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/123,502

(22) Filed: Dec. 16, 2020

(65) Prior Publication Data

US 2021/0187979 A1 Jun. 24, 2021

(30) Foreign Application Priority Data

Dec. 19, 2019 (JP) ..... JP2019-228982

(51) Int. Cl.
*B41J 15/04* (2006.01)
*B41J 13/10* (2006.01)

(52) U.S. Cl.
CPC ..... *B41J 15/042* (2013.01); *B41J 13/106* (2013.01); *B41J 15/046* (2013.01); *B41J 15/048* (2013.01)

(58) Field of Classification Search
CPC ..... B41J 15/042; B41J 15/046; B41J 13/106; B41J 15/048
See application file for complete search history.

(56) References Cited

U.S. PATENT DOCUMENTS 5,411,342 A * 5/1995 Horie ..... B41J 15/042 400/594
6,183,153 B1 * 2/2001 Kamoda ..... B41J 15/042 400/207
2015/0109396 A1 * 4/2015 Kawamoto ..... B41J 15/042 347/108

FOREIGN PATENT DOCUMENTS

JP 2005-169745 A 6/2005

* cited by examiner

*Primary Examiner* — Henok D Legesse
(74) *Attorney, Agent, or Firm* — Workman Nydegger

(57) ABSTRACT

A recording apparatus is configured to support a roll body on which a medium is wound in a rolled form, and to perform recording on the medium fed out from the roll body, the recording apparatus including a housing, and a roll unit configured to support the roll body, in which the roll unit is configured to transition to a first mode in which the roll unit is stored inside the housing in a state of not supporting the roll body, and to a second mode in which the roll unit is drawn out from inside the housing to outside the housing where the roll unit is configured to support the roll body.

5 Claims, 11 Drawing Sheets

RECORDING APPARATUS INCLUDING ROLL BODY SUPPORT UNIT

The present application is based on, and claims priority from JP Application Serial Number 2019-228982, filed Dec. 19, 2019, the disclosure of which is hereby incorporated by reference herein in its entirety.

BACKGROUND

1. Technical Field

The present disclosure relates to a recording device.

2. Related Art

In the related art, a recording apparatus is known, in which a roll unit configured to hold a recording medium in a rolled form is detachably provided to an apparatus main body, as described in JP 2005-169745 A.

Unfortunately, in the recording apparatus described above, when the roll unit is removed from the apparatus main body, the roll unit is reduced in size by a volume of the roll unit, however, there is an issue in that space-saving of an installation space of the whole apparatus including the roll unit has not been achieved because a space for storing the roll unit removed from the apparatus main body is required separately.

SUMMARY

The recording apparatus is a recording apparatus configured to support a roll body on which a medium is wound in a rolled form, and to perform recording on the medium fed out from the roll body, the recording apparatus including a housing, and a roll unit configured to support the roll body, in which the roll unit is configured to transition to a first mode in which the roll unit is stored inside the housing in a state of not supporting the roll body, and to a second mode in which the roll unit is drawn out from inside the housing to outside the housing where the roll unit is configured to support the roll body.

DESCRIPTION OF EXEMPLARY EMBODIMENTS

Figure 1:
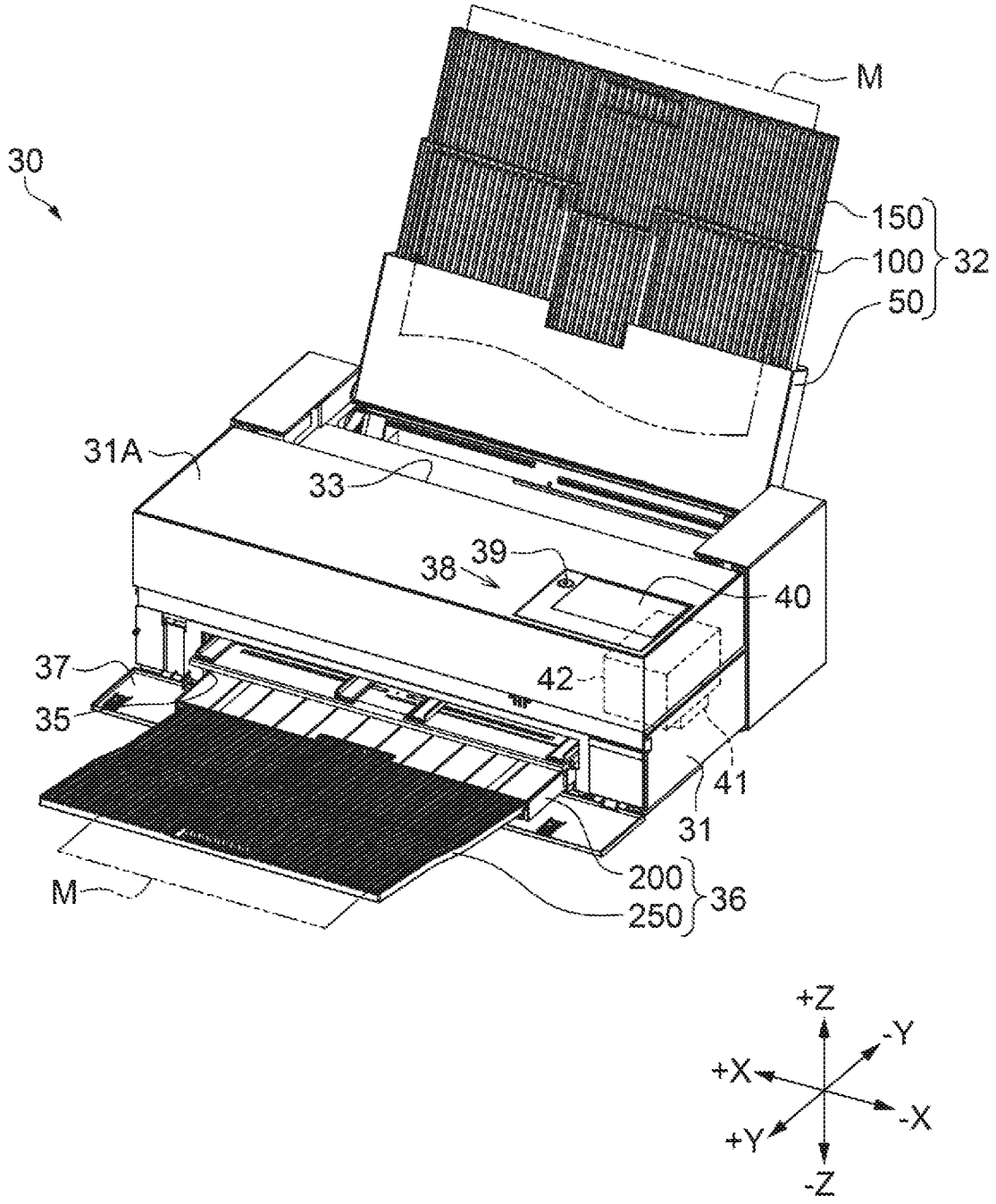
FIG. 1 is a perspective view illustrating a configuration of a recording apparatus.
Figure 2:
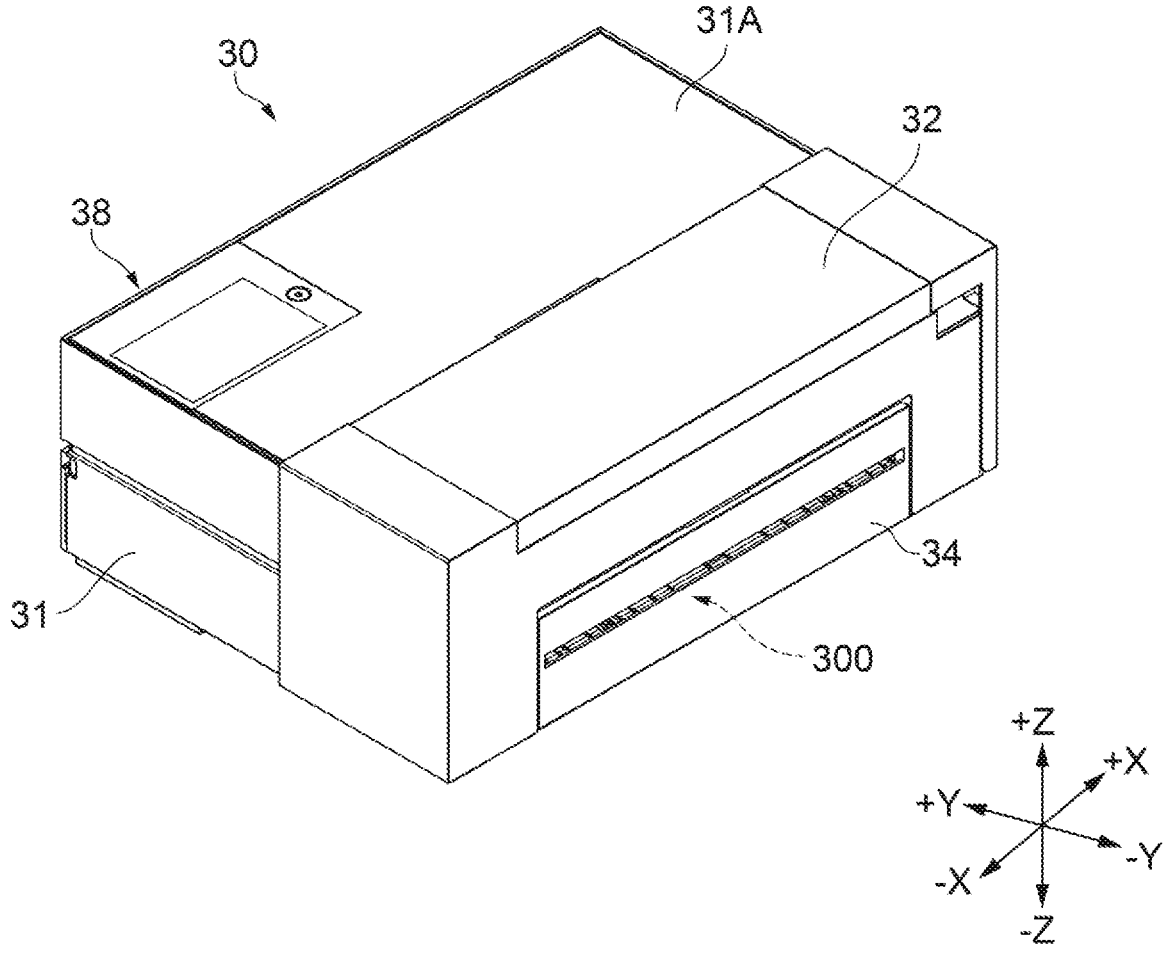
FIG. 2 is a perspective view illustrating a configuration of a recording apparatus.

A recording apparatus 30 illustrated in FIGS. 1 and 2 serves as an inkjet printer of a serial printing type. FIG. 1 is a front perspective view of the recording apparatus 30, and FIG. 2 is a rear perspective view of the recording apparatus 30.

The recording apparatus 30 includes a housing 31 of a substantially rectangular parallelepiped shape. An upper face 31A in a +Z direction of the housing 31 of the recording apparatus 30 is provided with a feeding tray 32 in which a user is allowed to set a paper sheet M as a medium on which recording is to be performed. The paper sheet M set in the feeding tray 32 is fed, through a feeding port 33, into the housing 31 of the recording apparatus 30. Note that FIG. 1 illustrates a state of an open position at which the feeding tray 32 holds the feeding port 33 in an open state where the feeding tray 32 opens the feeding port 33, and FIG. 2 illustrates a state of a close position at which the feeding tray 32 holds the feeding port 33 in a close state where the feeding tray 32 closes the feeding port.

The front in a +Y direction of the housing 31 of the recording apparatus 30 is provided with an ejection port 35 through which the paper sheet M, on which recording has been performed by the recording apparatus 30, is ejected, and an ejection tray 36 in which the paper sheet M on which the recording has been performed, ejected through the ejection port 35, is loaded. A lower front face of the housing 31 of the recording apparatus 30 is provided with a cover 37 of an openable type, where the ejection tray 36 stored inside the housing 31 of the recording apparatus 30 is covered by the cover 37 that is closed.

Further, the upper face 31A of the housing 31 of the recording apparatus 30 is provided with an operation panel 38. The operation panel 38 includes an operation unit 39 such as a power button, and a display unit 40 composed of a liquid crystal display and the like. The display unit 40 is configured to display a menu, various types of messages, and the like. The recording apparatus 30, which is communicably coupled to a host device (not illustrated), is configured to cause, when receiving recording data from the host device, a feeding mechanism (not illustrated) to feed the paper sheet M set in the feeding tray 32, and to perform recording operation for recording an image based on the recording data on the paper sheet M having been fed.

There is provided inside the housing 31 of the recording apparatus 30, a carriage 42 equipped with a recording head 41 configured to discharge a liquid such as ink or the like onto the paper sheet M in a manner reciprocally movable along an X axis (a scanning direction) orthogonal to a transport direction in which the paper sheet M is transported. A recording operation that the recording head 41 discharges liquid droplets to perform recording for one pass in the course that the carriage moving along the scanning direction and a transport operation of transporting the paper sheet M to the next recording position are alternately performed, to thus record an image or a document on the paper sheet M.

At a front portion inside the housing 31 of the recording apparatus 30 and at one or both of portions on both sides sandwiching the ejection tray 36, there are provided mounting portions (both of them not illustrated in the figure) to which liquid containers such as an ink cartridge for storing a liquid such as ink used for the recording are detachably mounted. Note that in this example, the liquid container is of an off-carriage type disposed at a position separate from the carriage 42, and the liquid container may also be of an on-carriage type that is detachably mounted on the carriage 42. Also, the recording apparatus 30 may include, without being limited to be of a serial recording type, the recording head 41 may be an elongated line head disposed across the entirety of the maximum width of the paper sheet M, as well as of a line recording type configured to concurrently discharge liquid droplets onto the entirety of the width of the paper sheet M.

The feeding tray 32 has a medium support structure of a three-stage structure that is constituted by a storage member 50, a first member 100, and a second member 150. The feeding tray 32 has a storage state where the storage member 50 stores the first member 100 and the second member 150, and a deployed state where the first member 100 and the second member 150 are drawn out from the storage member 50 by an operation of the user to allow the storage member 50, the first member 100, and the second member 150 to support the paper sheet M. As illustrated in FIG. 1, the feeding tray 32 is set in the deployed state at the open position, and as illustrated in FIG. 2, the feeding tray 32 is set in the storage state at the close position.

As illustrated in FIG. 2, the feeding tray 32 is disposed at the close position, at the time when being in the storage state, to hold the feeding port 33 in the close state, and becomes substantially flush with the upper face 31A of the housing 31 of the recording apparatus 30. As illustrated in FIG. 1, the feeding tray 32 is disposed at the open position to hold the feeding port 33 in the open state.

The ejection tray 36 is a portion at which the paper sheet M on which the recording has been performed is disposed. The ejection tray 36 has a medium support structure of a two-stage structure that is constituted by an ejection-side first member 200 and an ejection-side second member 250.

The ejection tray 36 has a storage state where the ejection-side first member 200 stores the ejection-side second member 250, and a deployed state where the ejection-side second member 250 is drawn out from the ejection-side first member 200 to allow the ejection-side first member 200 and the ejection-side second member 250 to support the paper sheet M. The ejection tray 36 is stored in the housing 31 of the recording apparatus 30 in the storage state. The ejection-side first member 200 is coupled, in a manner being drawable frontward, to the housing 31 of the recording apparatus 30. The ejection tray 36, when the ejection-side first member 200 and the ejection-side second member 250 are drawn out from the housing 31 of the recording apparatus 30 at the time when the ejection port 35 formed at the housing 31 of the recording apparatus 30 is in the open state, transitions to the deployed state.

Figure 4:
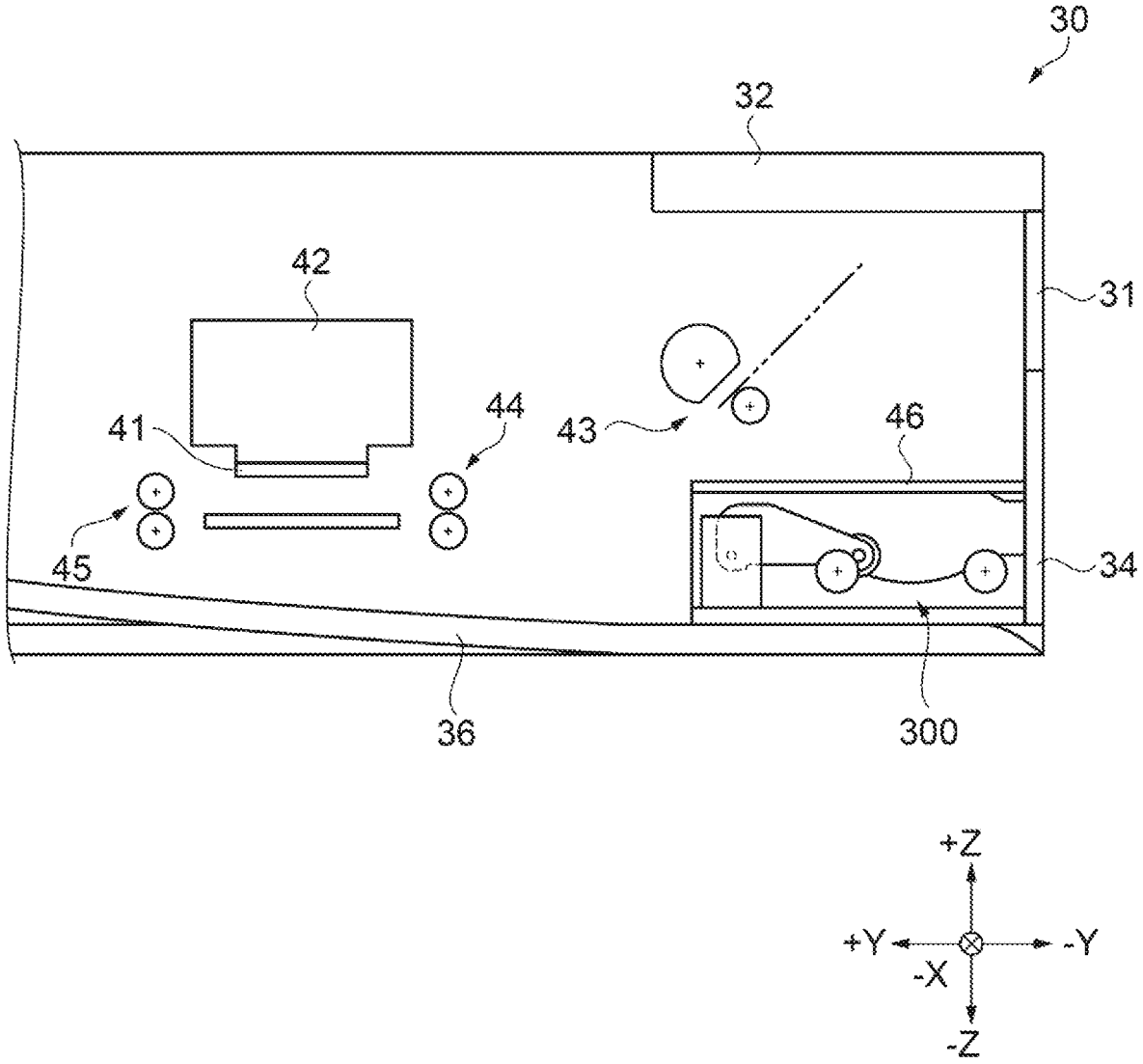
FIG. 4 is a cross-sectional view illustrating a configuration of a recording apparatus.

The recording apparatus 30 includes transport rollers 43, 44, and 45 configured to transport the paper sheet M through the feeding port 33, via the recording head 41, toward the ejection port 35 (see FIG. 4). The transport rollers 43, 44, and 45 are coupled to a drive motor and configured to rotate by a drive of the drive motor. The paper sheet M is transported by the rotation of the transport rollers 43, 44, and 45.

Figure 3:
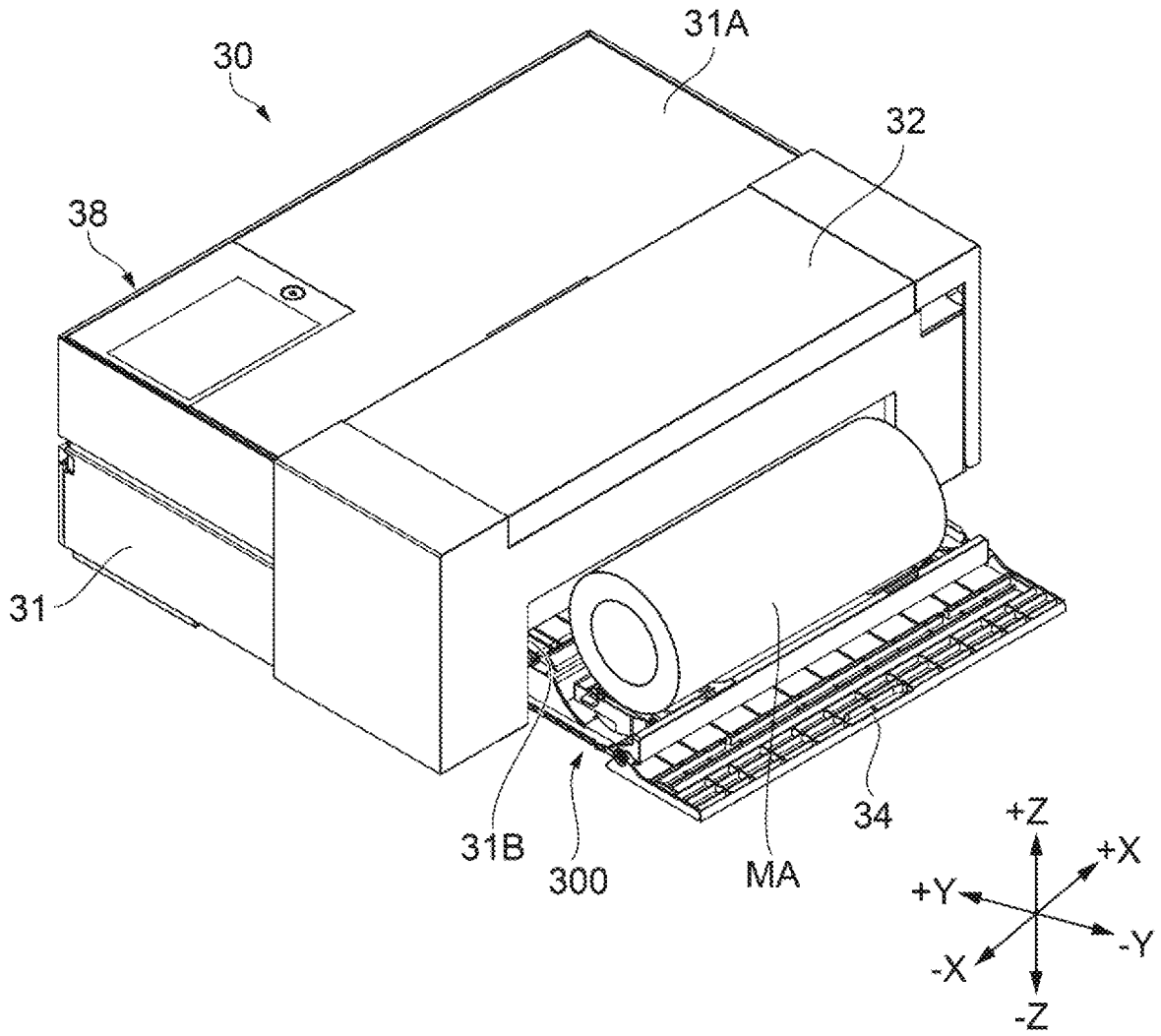
FIG. 3 is a perspective view illustrating a configuration of a roll unit.

Further, as illustrated in FIG. 3, the recording apparatus 30 of the embodiment is configured to support the roll body MA that the paper sheet M having an elongated form is wound in a rolled form, and to perform recording on the paper sheet M fed out from the roll body MA. That is, the recording apparatus 30 of the embodiment is configured to perform recording in either cases where the paper sheet M is in a form of a single sheet or the paper sheet M is in a form of the roll body MA. The recording apparatus 30 of the embodiment is also configured to make the roll body MA corresponding to paper sheet widths, such as an A4 size sheet, A3 size sheet, A3 elongation size sheet, and the like applicable, for example.

The recording apparatus 30 includes a roll unit 300 configured to support the roll body MA. As illustrated in FIG. 2, the roll unit 300 is configured to be storable inside the housing 31.

Then, when performing recording using the roll body MA, a lid portion 34 attached to the housing 31 is brought from the close state to the open state, and the roll unit 300 stored inside the housing 31 is drawn out to outside the housing 31 to be used, through an opening 31B that appears at the housing 31 by the lid portion 34 brought to the open state, as illustrated in FIG. 3. Specifically, the roll unit 300 stored inside the housing 31 is caused to move in a −Y direction, to thus expose the roll unit 300 to outside the housing 31. The roll unit 300 is restricted from moving in the −Y direction at a prescribed position relative to the housing 31. Also, the roll unit 300 is caused to move in the +Y direction to store the roll unit 300 inside the housing 31.

That is, the roll unit 300 of the recording apparatus 30 of the embodiment is configured to transition to a first mode in which the roll unit 300 is stored inside the housing 31, and to a second mode in which the roll unit 300 is drawn out from inside the housing 31 to outside the housing 31 where the roll unit is configured to support the roll body MA.

Hereinafter, a configuration and the modes of the roll unit 300 will be described in detail.

FIG. 4 illustrates the first mode in which the roll unit 300 is stored inside the housing 31. The roll unit 300 is stored in an end portion in the −Y direction, as well as in a −Z direction of the housing 31. In the embodiment, the roll unit 300 is stored below a paper sheet transport plate 46 constituting a transport path on which the paper sheet M fed out from the roll body MA is transported. A side in the −Y direction of the roll unit 300 stored inside the housing 31 is covered by the lid portion 34 of a plate-like shape that is attached to the housing 31.

Here, the storage of the roll unit 300 inside the housing 31 in the first mode means a state where the roll unit 300 is covered in the external appearance by the housing 31 without overhanging from an outer shape of the housing 31 that includes the lid portion 34 in the close state, when the recording apparatus 30 is installed at the bottom face on an XY face, as illustrated in FIG. 2. That is, in the first mode, the recording apparatus 30, at a side of the bottom face, may have a configuration in which the roll unit 300 is covered, or may have a configuration in which the roll unit 300 is exposed. Note that in the embodiment, the roll unit 300 is covered by the ejection tray 36 when the ejection tray 36 is stored in the housing 31 in the storage state, as the recording apparatus 30 is viewed from the side of the bottom face in the first mode. On the other hand, when the ejection tray 36 is drawn out from the housing 31 to be in the deployed state, the roll unit 300 is brought to a state where the roll unit 300 is exposed.

In the first mode, the roll unit 300 is stored inside the housing 31 in a state of not supporting the roll body MA. This saves a space by a volume of the roll body MA, reducing a dimension of the outer shape of the housing 31. Also, the roll unit 300, when performing recording, transitions from the first mode to the second mode to appear outside the housing 31. The roll body MA becomes supportable in the second mode and the roll unit 300 supports the roll body MA, which enables to perform recording. This makes it possible, even with a configuration including the roll unit 300, to achieve space-saving of an installation space of the whole of the recording apparatus 30.

Figure 5:
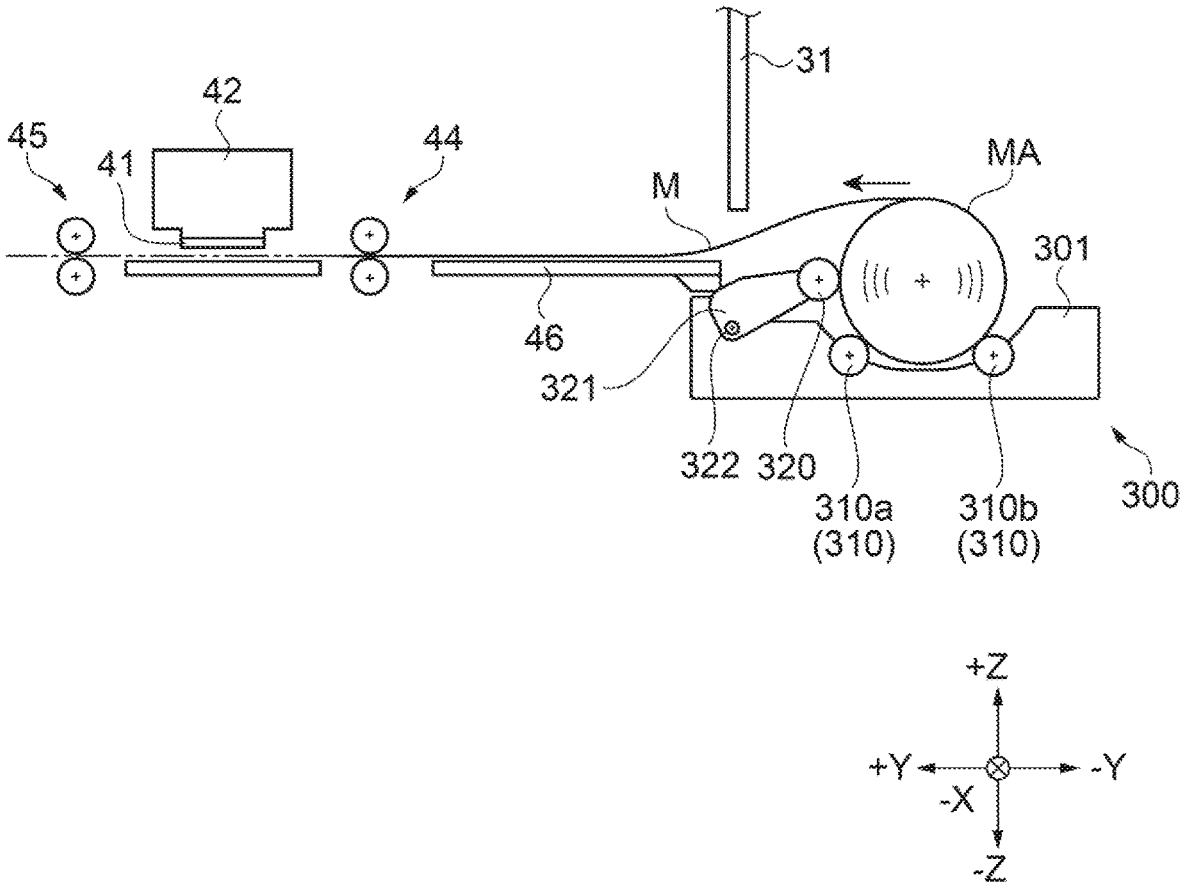
FIG. 5 is a schematic view illustrating a configuration of a roll unit.
Figure 6:
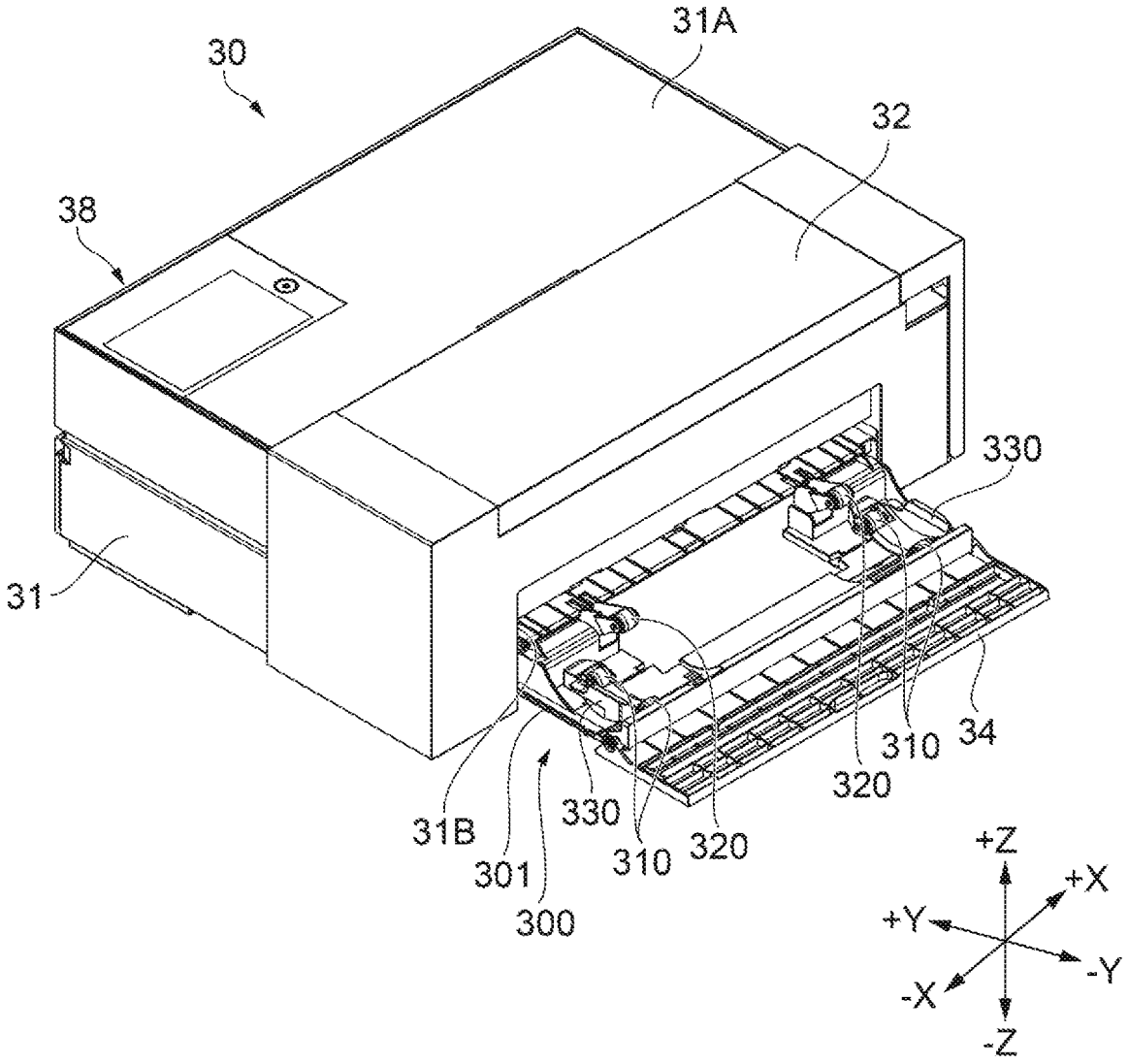
FIG. 6 is a perspective view illustrating a configuration of a roll unit.
Figure 7:
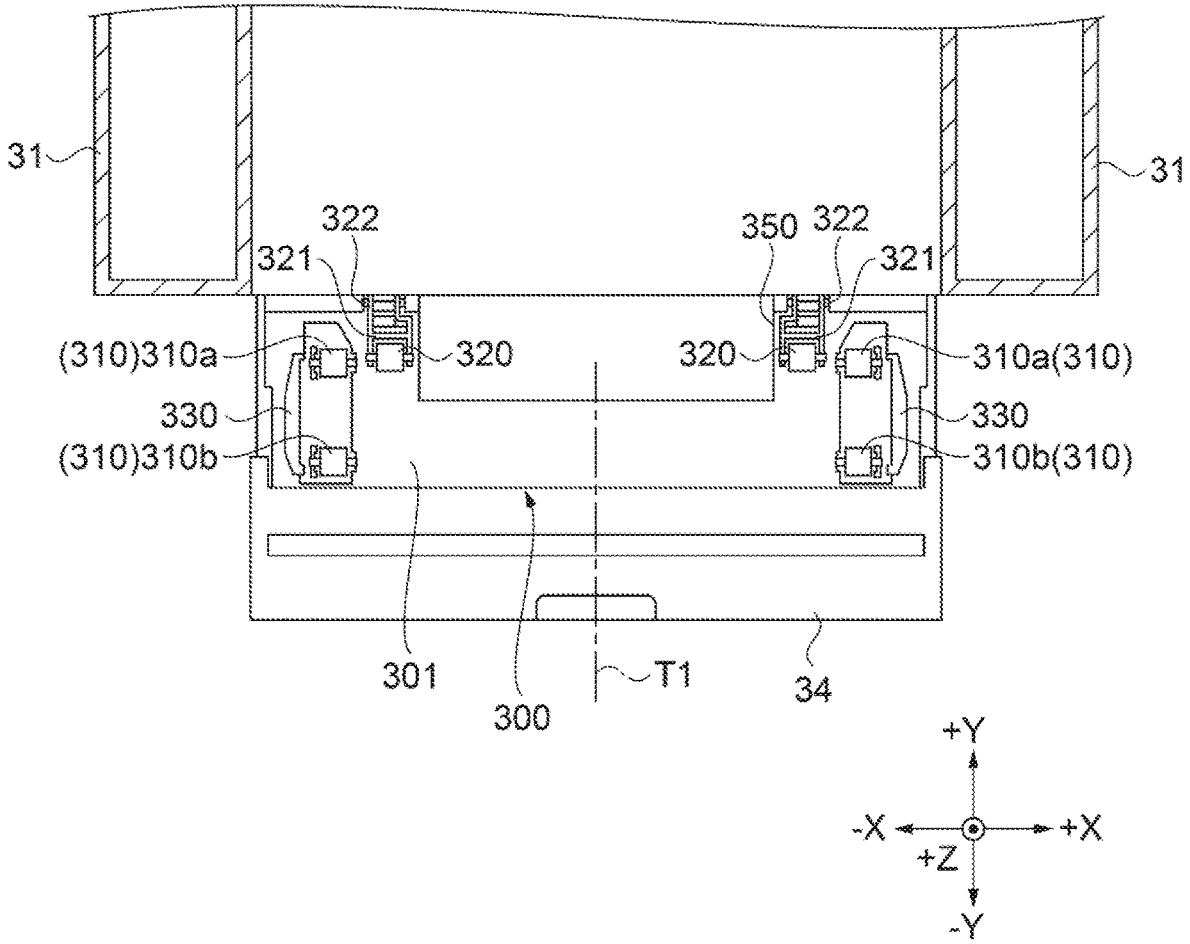
FIG. 7 is a plan view illustrating a configuration of a roll unit.

As illustrated in FIGS. 5, 6, and 7, the roll unit 300 includes a lower-portion support roller 310 configured to support a lower portion of the roll body MA. That is, the lower-portion support roller 310 is disposed at a position receiving the load of the roll body MA.

In the embodiment, the roll unit 300 includes a plurality of the lower-portion support rollers 310 (310*a* and 310*b*). Specifically, the lower-portion support roller 310 is disposed in two pieces at each of sides in a −X direction and a +X direction, which coincide with a longitudinal direction of a base body 301 of a plate-like shape of the roll unit 300. The lower-portion support roller 310*a* and the lower-portion support roller 310*b* each disposed in the longitudinal direction of the base body 301 are disposed along a Y axis.

The lower-portion support roller 310 is a driven roller, and the roll body MA rotates counter clockwise by a drive of the transport roller 44 in FIG. 5. The lower-portion support roller 310 is configured to rotate in conjunction with the rotation of the roll body MA.

As illustrated in FIG. 5, the lower-portion support roller 310*a* and the lower-portion support roller 310*b* are arranged in a manner sandwiching, in a horizontal direction, an axial core of the roll body MA that is supported. This makes it possible to support the roll body MA in a stable state. Also, the lower-portion support roller 310*a* and the lower-portion support roller 310*b* are provided at positions in contact with an outer circumferential face of the roll body MA even when the roll body MA decreases diameter due to the paper sheet M fed out from the roll body MA. This makes it possible to suppress frictional resistance compared to a configuration of supporting, by a face, the lower portion of the roll body MA, thus enhancing transport properties of the paper sheet M. This also makes it possible to suppress the occurrence of damage and the like of the roll body MA.

Further, the roll unit 300 includes a side support roller 320 configured to support, downstream in a transport direction in which the roll body MA is transported, a lateral side along a longitudinal direction of the roll body MA. That is, the side support roller 320 supports the lateral side on a side in the +Y direction relative to the axial core of the roll body MA. In the embodiment, the roll unit 300 includes a plurality of the side support rollers 320. Specifically, the side support rollers 320 are disposed in a single piece at each of the sides in the −X direction and the +X direction, which coincide with the longitudinal direction of the base body 301.

The side support roller 320, which is a driven roller, is configured to rotate in conjunction with the rotation of the roll body MA. The side support roller 320 restricts, in the second mode, the roll body MA from moving in the +Y direction. This makes it possible to suppress a misalignment of the roll body MA toward the side of the transport direction in which the roll body MA is transported, thus enhancing the transport properties of the paper sheet M.

In the embodiment, an arm unit 321 configured to rotatably support the side support roller 320 is provided. The arm unit 321 is attached, via a shaft 322, to the base body 301. The side support roller 320 is attached to a tip end of the arm unit 321. The shaft 322 is provided, at the arm unit 321, at a base end opposite to the side support roller 320.

Figure 8:
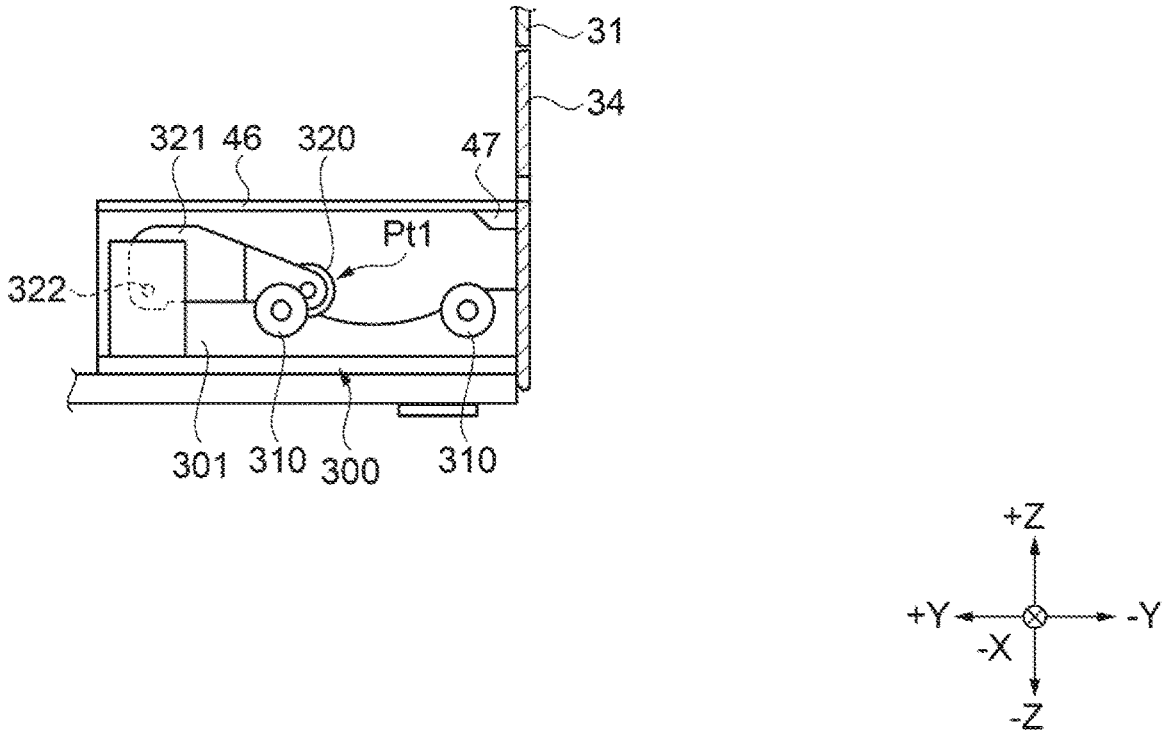
FIG. 8 is a schematic view illustrating an operation of a side support roller.
Figure 9:
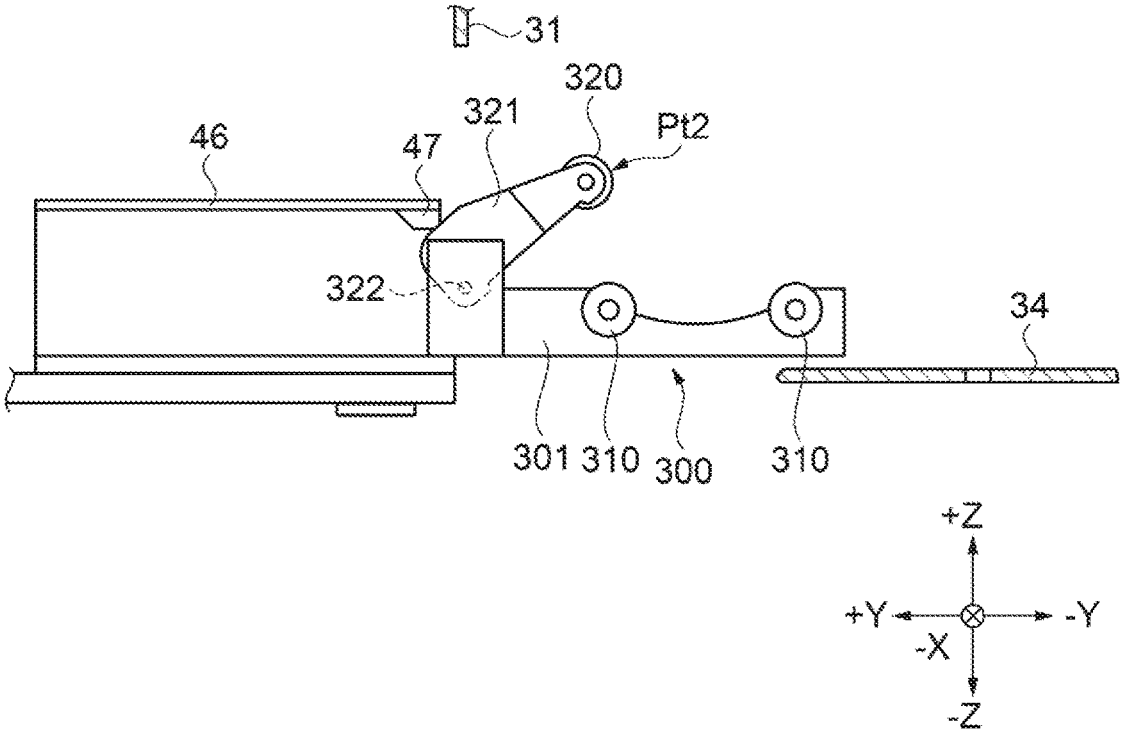
FIG. 9 is a schematic view illustrating an operation of a side support roller.

The side support roller 320 is also configured to be movable to a first position Pt1 on a lower side of the roll unit 300 in the first mode, and a second position Pt2 as a position higher than the first position Pt1 in the second mode (see FIGS. 8 and 9).

As illustrated in FIG. 8, the side support roller 320 is located at the first position Pt1 in the first mode. That is, the side support roller 320 is located at a side of the base body 301. This allows the roll unit 300 to become storable further compactly regarding the height direction of the roll unit 300.

Here, a protrusion 47 of a convex form is provided toward the −Z direction at a lower face on a side in the −Z direction of the paper sheet transport plate 46 More specifically, the protrusion 47 is provided at an end portion in the −Y direction of the paper sheet transport plate 46. The protrusion 47 is also provided at a position overlapping on the Y axis with the arm unit 321. In the first mode, the arm unit 321 avoids a contact with the protrusion 47, where the protrusion 47 is located in the −Y direction relative to the arm unit 321.

Then, in the course of drawing out the roll unit 300 in the −Y direction from inside the housing 31, the protrusion 47 makes contact with an upper portion of the arm unit 321. The arm unit 321 is then restricted from moving in the −Y direction, and rotates counterclockwise about the shaft 322 in FIG. 9. As illustrated in FIG. 9, the roll unit 300 reaches the second mode, then the rotational movement of the arm unit 321 stops, and the side support roller 320 is held at the second position Pt2. The side support roller 320, when located at the second position Pt2, is in a state of being able to support a lateral side of the roll body MA.

The roll unit 300 also includes an edge guide 330 configured to clamp an end portion in the longitudinal direction of the roll body MA. The edge guide 330 is provided at the sides in the −X direction and the +X direction of the base body 301. The edge guide 330 includes a guide portion convexly protruding in the +Z direction from the base body 301. Two pieces of the edge guides 330 are located to become linearly symmetrical with respect to a center axis T1 in a direction along the X axis of the base body 301. The edge guides 330 make contact with both end portions in the longitudinal direction of the roll body MA in a manner sandwiching the roll body MA that is supported, to define a position of the roll body MA.

Two pieces of the edge guides 330 are configured to interlock with each other. The two pieces of the edge guides 330 move to become linearly symmetrical to each other relative to the center axis T1. For example, one of the edge guides 330 is caused to move closer to the center axis T1, the other of the edge guides 330 also moves closer to the center axis T1. This makes it possible to cope with a size in the longitudinal direction of the roll body MA that is supported. The roll body MA of which the position is defined by the edge guides 330 is located such that the center in the axial direction of the roll body MA passes through the center axis T1. This allows the roll body MA to be supported in a stable state.

In the embodiment, the lower-portion support rollers 310*a* and 310*b* located at a side in a −X axis direction of the roll unit 300 are attached to the edge guide 330 provided at the side in the −X axis direction, and the lower-portion support rollers 310*a* and 310*b* located at a side in a +X axis direction of the roll unit 300 are attached to the edge guide 330 provided at the side in the +X axis direction. Thus, when the edge guide 330 moves, the lower-portion support rollers 310*a* and 310*b* that are attached also move. This makes it possible to suppress the misalignment in the longitudinal direction of the roll body MA, thus enhancing the transport properties of the paper sheet M. Also, in the embodiment, a member such as a spindle that support both end portions in the longitudinal direction of the roll body MA can be abbreviated, thus miniaturizing the recording apparatus 30, simplifying the configuration of the roll unit 300.

Next, an operability of the edge guide 330 when transitioning from the second mode to the first mode will be described.

For example, when the roll body MA of the paper sheet M of the A3 elongation size sheet is supported by the roll unit 300, both of the edge guides 330 are brought to a state of overhanging outward from both end portions in the direction along the X axis of the base body 301. In this case, a dimension in the direction along the X axis between the edge guides 330 is larger than the dimension in the direction along the X axis of the base body 301. Further, the dimension in the direction along the X axis between the edge guides 330 is larger than the dimension in the direction along the X axis of the opening 31B of the housing 31. Accordingly, the edge guides 330, in a state where both of the edge guides 330 overhang outward from the base body 301, make contact with the housing 31 to prevent the roll unit 300 from being stored inside the housing 31. This makes it necessary to cause both of the edge guides 330 to once move to inside the base body 301 and to then move to a side of the housing 31, which makes it impossible to achieve efficient operability.

Under such a circumstance, in the embodiment, even when the both of the edge guides 330 are caused to move to the side of the housing 31 in a state where the both of the edge guides 330 are overhanging outward from the base body 301 in the second mode, the both of the edge guides 330 is caused to move, in the course of the movement to the side of the housing 31, to a side of the center axis T1, to thus transition to the first mode.

Figure 10:
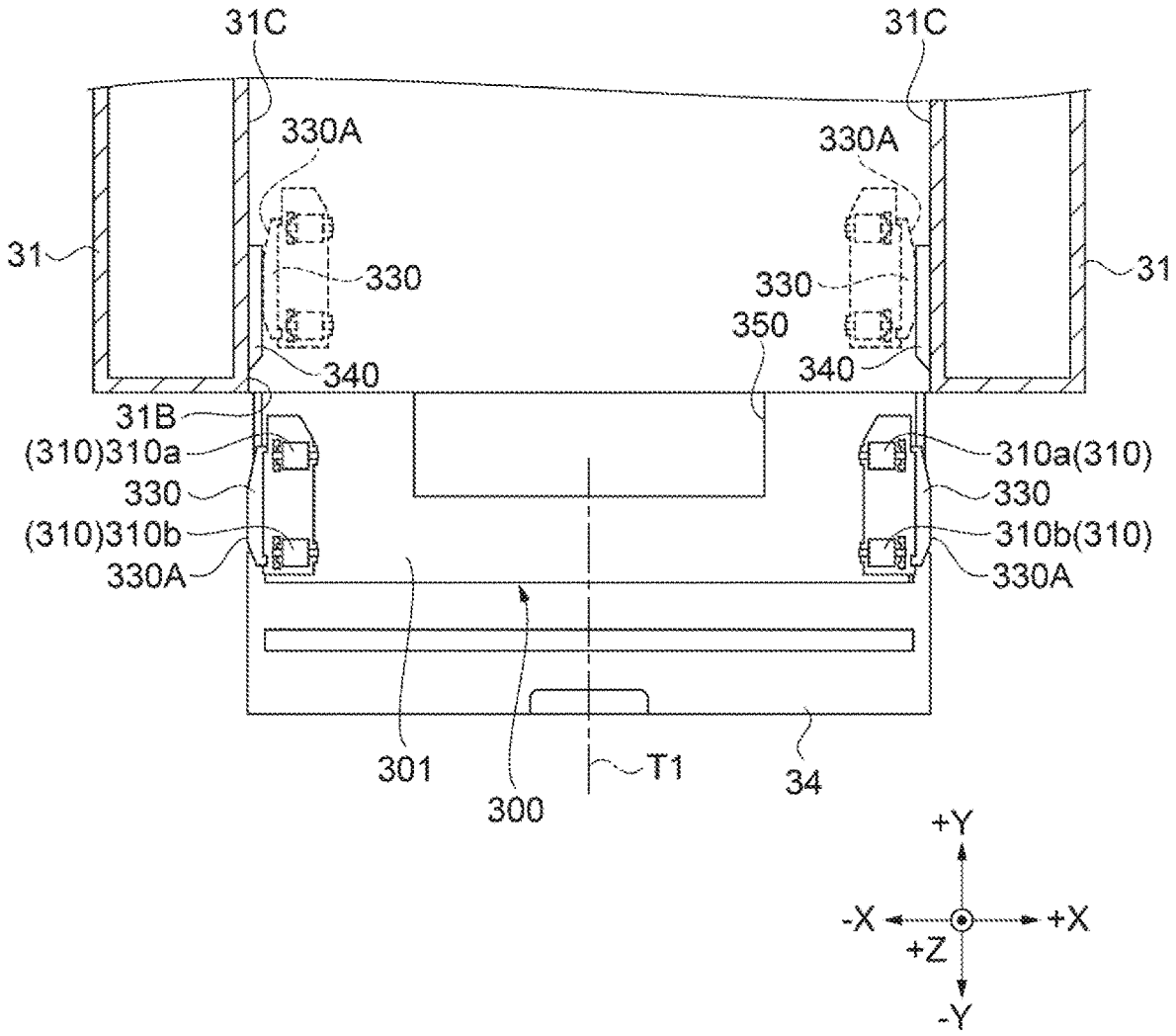
FIG. 10 is a schematic view illustrating an operation of an edge guide.

Specifically, as illustrated in FIG. 10, a frame 31C inside the housing 31 is provided with a convex portion 340 convexly protruding toward the side of the center axis T1. The convex portion 340 is provided corresponding to the both of the edge guides 330.

The roll unit 300 is then caused to move in the +Y direction, then, an outer side face 330A of each of the edge guides 330 comes into contact with the convex portion 340. When the edge guides 330 make contact with the convex portion 340, the edge guides 330 move to the side of the center axis T1 in conformance with the convex portion 340. This makes the dimension between the two pieces of the edge guides 330 become narrow, allowing the roll unit 300 to move into the housing 31, and to transition to the first mode. This makes it unnecessary for the user to move the edge guides 330 to the side of the center axis T1 beforehand, thus enhancing the operability.

On the other hand, even when the dimension between the both of the edge guides 330 is in a state of being narrower in the second mode than that defined, the both of the edge guides 330 can be moved away from the side of the center axis T1 in the course of moving the roll unit 300 to the side of the housing 31, to thus transition to the first mode.

Figure 11:
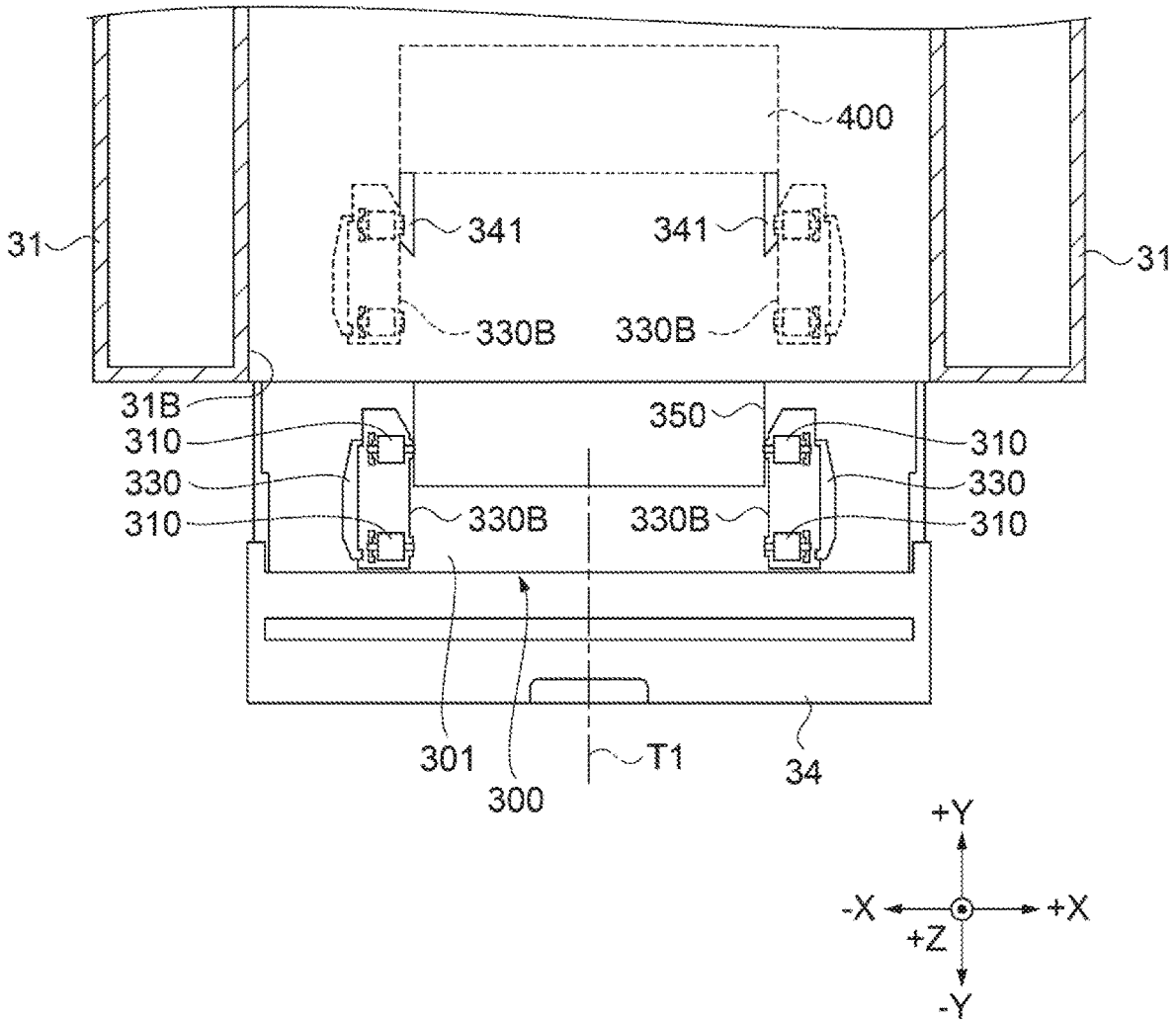
FIG. 11 is a schematic view illustrating an operation of an edge guide.

Specifically, as illustrated in FIG. 11, a convex portion 341 convexly protruding toward a direction opposite to the side of the center axis T1 is provided inside the housing 31. The convex portion 341 is provided corresponding to the both of the edge guides 330.

The roll unit 300 is then caused to move in the +Y direction, then, an inner side face 330B of each of the edge guides 330 comes into contact with the convex portion 341. When the edge guides 330 make contact with the convex portion 341, the edge guides 330 move away from the side of the center axis T1 in conformance with the convex portion 341. This makes it possible to transition to the first mode in a state where the dimension between both of the edge guides 330 becomes wide. Note that the convex portion 341 of the embodiment is disposed at an installation portion 400 disposed at a bottom face of the housing 31 of the recording apparatus 30. Specifically, the convex portion 341 is disposed at an end portion in the −Y direction of the installation portion 400, and at each of end portions in the −X direction and the +X direction. This makes it possible to transition to the first mode, avoiding an interference between the roll unit 300 and the installation portion 400.

The installation portion 400 is a power supply unit, for example. The power supply unit may also be configured to supply a drive power to each of drive units. The installation portion 400 of the embodiment is disposed at a side in the −Y direction of the bottom face of the housing 31, as well as at substantially a central portion on the X axis.

Figure 12:
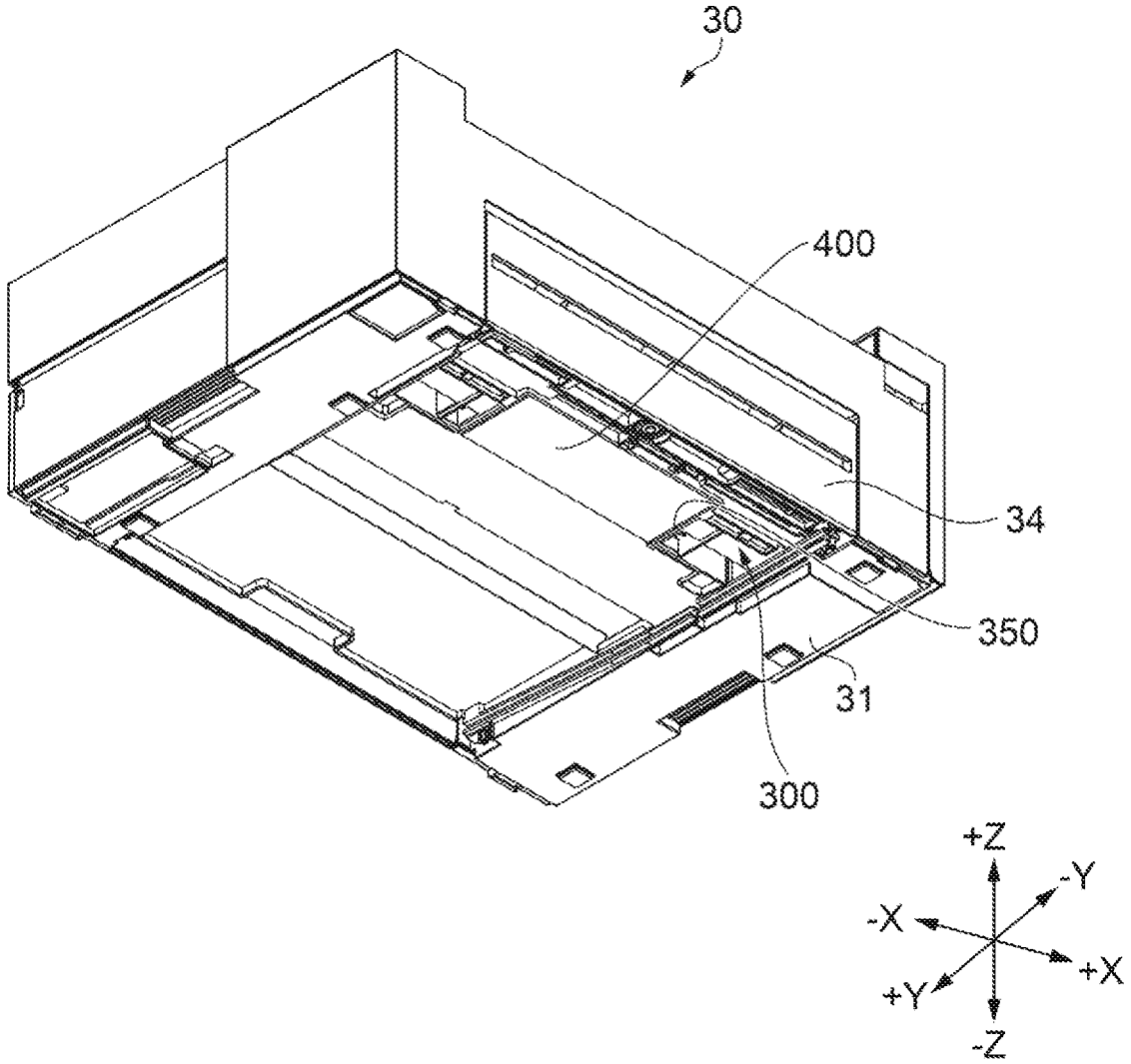
FIG. 12 is a bottom face view illustrating a configuration of a recording apparatus.

As illustrated in FIGS. 7 and 12, the roll unit 300 includes a cut-out portion 350 configured to avoid the installation portion 400 in the first mode.

The installation portion 400 forms a rectangular shape in plan view. The cut-out portion 350 forms a concave portion to face three sides that form an outer shape of the installation portion 400. A dimension in a direction along the X axis of the cut-out portion 350 is larger than the dimension in the direction along the X axis of the installation portion 400. Further, a dimension in a direction along the Y axis of the cut-out portion 350 is equivalent to the dimension in the direction along the Y axis of the installation portion 400.

In the first mode, the installation portion 400 fits in the cut-out portion 350. In other words, the roll unit 300 overlaps in the X axis direction with the installation portion 400.

This allows, in the first mode, the roll unit 300 to become storable, to avoid an interference with the installation portion 400. Then, the roll unit 300 can be configured in a minimum necessary size, achieving the space-saving of the installation space of the whole of the recording apparatus 30.

What is claimed is:

1. A recording apparatus, configured to support a roll body on which a medium is wound in a rolled form, and to perform recording on the medium fed out from the roll body, the recording apparatus comprising:

a housing; and a roll unit configured to support the roll body, wherein the roll unit is configured to transition to a first mode in which the roll unit is stored inside the housing in a state of not supporting the roll body such that the roll body is not stored inside the housing during the first mode, and to a second mode in which the roll unit is drawn out from inside the housing to outside the housing where the roll unit is configured to support the roll body.

2. The recording apparatus according to claim 1, wherein the roll unit includes a lower-portion support roller configured to support a lower portion of the roll body.

3. The recording apparatus according to claim 1, wherein the roll unit includes a side support roller configured to support, downstream in a transport direction in which the roll body is transported, a lateral side along a longitudinal direction of the roll body, wherein the side support roller is located, in the first mode, at a first position on a lower side of the roll unit, and moves, in the second mode, to a second position that is a position higher than the first position, to support the lateral side of the roll body.

4. The recording apparatus according to claim 1, wherein the roll unit includes an edge guide that defines an end portion in the longitudinal direction of the roll body.

5. The recording apparatus according to claim 1, wherein an installation portion is fixed to a bottom face of the housing, and the roll unit includes a cut-out portion configured to avoid the installation portion in the first mode.

* * * * *